US006857230B2

(12) United States Patent
Owen

(10) Patent No.: US 6,857,230 B2
(45) Date of Patent: Feb. 22, 2005

(54) RAISED FLOORING SYSTEM AND METHOD

(75) Inventor: David D. Owen, 9 Sagebush La., Hilton Head, SC (US) 29926

(73) Assignee: David D. Owen, Hilton Head, SC (US)

( * ) Notice: Subject to any disclaimer, the term of this patent is extended or adjusted under 35 U.S.C. 154(b) by 0 days.

(21) Appl. No.: 10/347,662

(22) Filed: Jan. 20, 2003

(65) Prior Publication Data

US 2004/0139671 A1 Jul. 22, 2004

(51) Int. Cl.[7] ..... E04B 5/00
(52) U.S. Cl. ..... 52/126.6; 52/263; 248/188.8
(58) Field of Search ..... 52/126.6, 126.5, 52/126.7, 263, 220.1; 248/188.8

(56) References Cited

U.S. PATENT DOCUMENTS

| | | | | |
|---|---|---|---|---|
| 3,899,857 A | | 8/1975 | Mochizuki | |
| 4,319,520 A | | 3/1982 | Lanting et al. | |
| 4,368,869 A | | 1/1983 | Gelvezon et al. | |
| 4,546,580 A | * | 10/1985 | Ueno et al. | 52/126.1 |
| 4,606,156 A | | 8/1986 | Sweers et al. | |
| 4,676,036 A | * | 6/1987 | Bessert | 52/126.6 |
| 4,719,727 A | | 1/1988 | Cooper et al. | |
| 4,729,859 A | | 3/1988 | Munsey et al. | |
| 4,850,176 A | | 7/1989 | Munsey et al. | |
| 4,874,127 A | | 10/1989 | Collier | |
| RE33,220 E | | 5/1990 | Collier | |
| 5,048,242 A | | 9/1991 | Cline | |
| 5,049,700 A | * | 9/1991 | Kobayashi et al. | 174/48 |
| 5,111,630 A | | 5/1992 | Munsey et al. | |
| 5,333,423 A | * | 8/1994 | Propst | 52/126.6 |
| 5,345,779 A | | 9/1994 | Feeney | |
| 5,363,613 A | | 11/1994 | Sevier | |
| 5,392,571 A | | 2/1995 | Greenfield | |
| 5,400,554 A | * | 3/1995 | Lo | 52/126.5 |
| 5,477,649 A | | 12/1995 | Bessert | |
| 5,483,776 A | | 1/1996 | Poppe | |
| 5,499,476 A | | 3/1996 | Adams et al. | |
| RE35,369 E | | 11/1996 | Ducroux et al. | |
| 5,791,096 A | * | 8/1998 | Chen | 52/126.6 |
| 6,061,982 A | | 5/2000 | Owen | |
| 6,363,685 B1 | * | 4/2002 | Kugler | 52/745.05 |
| 6,370,831 B1 | * | 4/2002 | Marshall et al. | 52/263 |
| 6,508,037 B1 | * | 1/2003 | Owen | 52/220.1 |

FOREIGN PATENT DOCUMENTS

| | | | |
|---|---|---|---|
| FR | 2559529 | * | 2/1984 |

* cited by examiner

*Primary Examiner*—Leslie A. Braun
*Assistant Examiner*—Tan Le
(74) *Attorney, Agent, or Firm*—Watts Hoffmann Co., LPA

(57) ABSTRACT

An improved pedestal for a flooring system of the type which utilizes prefabricated base panels installed in side by side relationship to support a series of upstanding pedestals positioned in a geometric pedestal array is disclosed. The pedestals support further panels which define chases. Working floor panels are mounted atop caps which form tops of the pedestals. In one embodiment the caps each thread into a threaded bore in a pedestal body for leveling adjustments. Novel feet project downwardly from the pedestal bodies to provide positive locks with the base panels.

10 Claims, 3 Drawing Sheets

RAISED FLOORING SYSTEM AND METHOD

This invention relates to an accessible raised floor system for use in office buildings or the like.

BACKGROUND OF THE INVENTION

Historically, building owners have not had to deal with tenant requirements for supplemental cooling, power and cabling, with the exception of special purpose computer or trading rooms. These special purpose rooms have been dealt with almost as if they were separate structures. Unless a building was occupant owned, a tenant had to deal with these requirements. Now, due to the changes in market economies, frequently landlords are forced to solve problems of substantial increases in power requirements, additional cooling and cable distribution.

As the use of office space has evolved since the development of personal computers (PC), there has been an escalation in the need for and frequency of re-organization and re-configuration of office space. Enormous amounts of effort and study have gone into the planning and design of office space in order to render its use more flexible and sympathetic to user functions. Most of these efforts have been concentrated in modular space planning and systems furniture engineered to accommodate PCs.

Modern day office requirements have placed burdens on heating/cooling, electrical power distribution and cabling systems which were never anticipated when even the most modern office buildings were built. The rates of office reorganization and reconfiguration have escalated from about 10% to 15%, per year U.S. averages, in the early 1990's, to 35% to 50% in the mid 1990's, with some companies and industries exceeding 100% per year. The technological life expectancy of local and wide area networks cabling and connectors is currently about eighteen months to two years.

Physical concentrations of PCs and other electrical enhancements such as facsimile machines, copiers, printers, scanners, and in particular, the personnel operating the equipment, have placed extra-ordinary burdens on the most sophisticated and powerful heating, ventilating and air conditioning systems. These concentrations of equipment and personnel generated heat are most frequently offset by increasing the velocity of chilled air from overhead diffusers, usually at the expense of other areas, and to the discomfort of personnel.

Traditionally and technically there have been roughly seven predominant methods of distributing heating/cooling, electrical power and cable in horizontal planes from vertical sources, whether from a building core or from other vertical chases. They have been:

1) Through a ceiling plenum;

2) Through the use of conventional raised flooring systems, as have been used in computer rooms;

3) In-floor conduits or proprietary ducts;

4) A combination of plenum and under-floor distribution through rigid conduit into poke-through outlet boxes to the floor above;

5) Through stud and drywall partitions and/or column enclosures;

6) Through power poles; and,

7) Through system furniture panels.

All of these systems require the feeding of electrical power wiring and cabling through studding, systems furniture, in-floor conduit or ducts. Convenient, horizontal retro-feeding of electrical power wiring or cabling through finished stud and dry wall partitions is particularly difficult, costly, disruptive and sometimes, impossible unless sufficient conduit has been pre-installed.

The most flexible and common of these systems has been the use of ceiling plenums. This plenum approach has severe difficulties and limitations. All work must be performed from ladders or scaffolding. Most connections to work surfaces must be through stud and dry wall partitions or so-called power poles vertically to work surface or floor levels and then distributed horizontally using more stud and dry wall partitions, systems furniture or in-floor conduit or duct.

Once additional power is in place, an undesirable result is a comparable increase in generated heat, requiring more cooling. Typically such additional heat loads have not been anticipated nor dealt with in the base building design or construction.

Localized cooling solutions are being dealt with by trying to increase the output of existing systems such as pushing more air by using higher blower velocities. Increases in air velocities result in increased noise levels and are really nothing more than cycling air more rapidly through the base system which has a finite heat absorbing capacity.

There have been proposals for retrofitted auxiliary flooring systems all of which suffer distinct disadvantages. With one proposal, a lower forced air plenum would be provided for conducting supplemental cooling air to a workspace where heat generating electronic equipment has been installed. Other flooring components would be formed to define enclosed ducts above the air plenum for power cables and communication conductors. It is necessary that these enclosed ducts have imperforate walls to prevent spread of an electrical fire. In the event of such a fire, the egress of the supplemental conditioning air from the plenum would obviously be undesirable. It is for these reasons that building codes require all wiring be encased in fire resistant conduit.

Prior proposals for supplemental flooring systems have all been excessively complex such that they required skilled installers for disproportionately long periods of time. Further, prior proposed systems have not been fully modular and had inadequate provision for access to service lines extending through such a system.

Simple to install supplemental flooring systems which will quickly and flexibly accommodate power cable, communication wiring, and supplemental cooling to meet the demands of both current day and future electronic equipment are described and claimed in U.S. Pat. Nos. 6,061,982 and 6,508,037 Issued May 16, 2000 and Jan. 21, 2003 (The Improvement Patent), each entitled Raised Flooring System & Method and each is incorporated herein by reference. As systems described in the patents have been developed, a need for more precise leveling of the work floor panels has arisen as has a need for more secure interconnection of pedestals and base panels.

SUMMARY OF THE INVENTION

The present invention is directed to an improved plastic pedestal to supplant the pedestal of FIG. 17 of The Improvement Patent. The improved pedestal provides enhanced interconnection both between the pedestal and base flooring panels under the pedestal and working floor panels atop the pedestal. In addition the improved pedestal provides the option of working floor leveling where desired.

As with the referenced patents the pedestals include axially aligned, cylindrical segments of diminishing diameters from bottom to top. Chase panels with arcuate cutouts rest atop flat, annular horizontal surfaces between adjacent, pedestal segments. Each pedestal has a threaded axial bore extending downwardly from the support surface.

Two types of work floor support caps are provided. Each of the caps has a cylindrical depention projecting downwardly from a circular disc. The depention extends, when in use, into the axial bore of an associated pedestal. The cap discs function to support working floor panels. The caps also have upward projecting locators which coact with apertures in working floor panels to fix the working floor panels in position.

The difference between the two types of caps resides in the depentions. In one cap type the depention is threaded to coact with a pedestal bore for floor leveling while with the other type the depention has a cylindrical surface which simply telescopes into a pedestal bore when floor leveling is not required.

Each pedestal has a set of four spaced feet. Each foot is sufficiently flexible to snap into a mating hole in an associated one of four base panels. The feet and the holes are complementally configured to lock the panels together and the pedestals to the base panels.

Accordingly the objects of the invention are to provide a novel and improved pedestal and complemental panels for a raised floor system and a method of using such pedestals.

DETAILED DESCRIPTION OF THE PREFERRED EMBODIMENT

Figure 1:
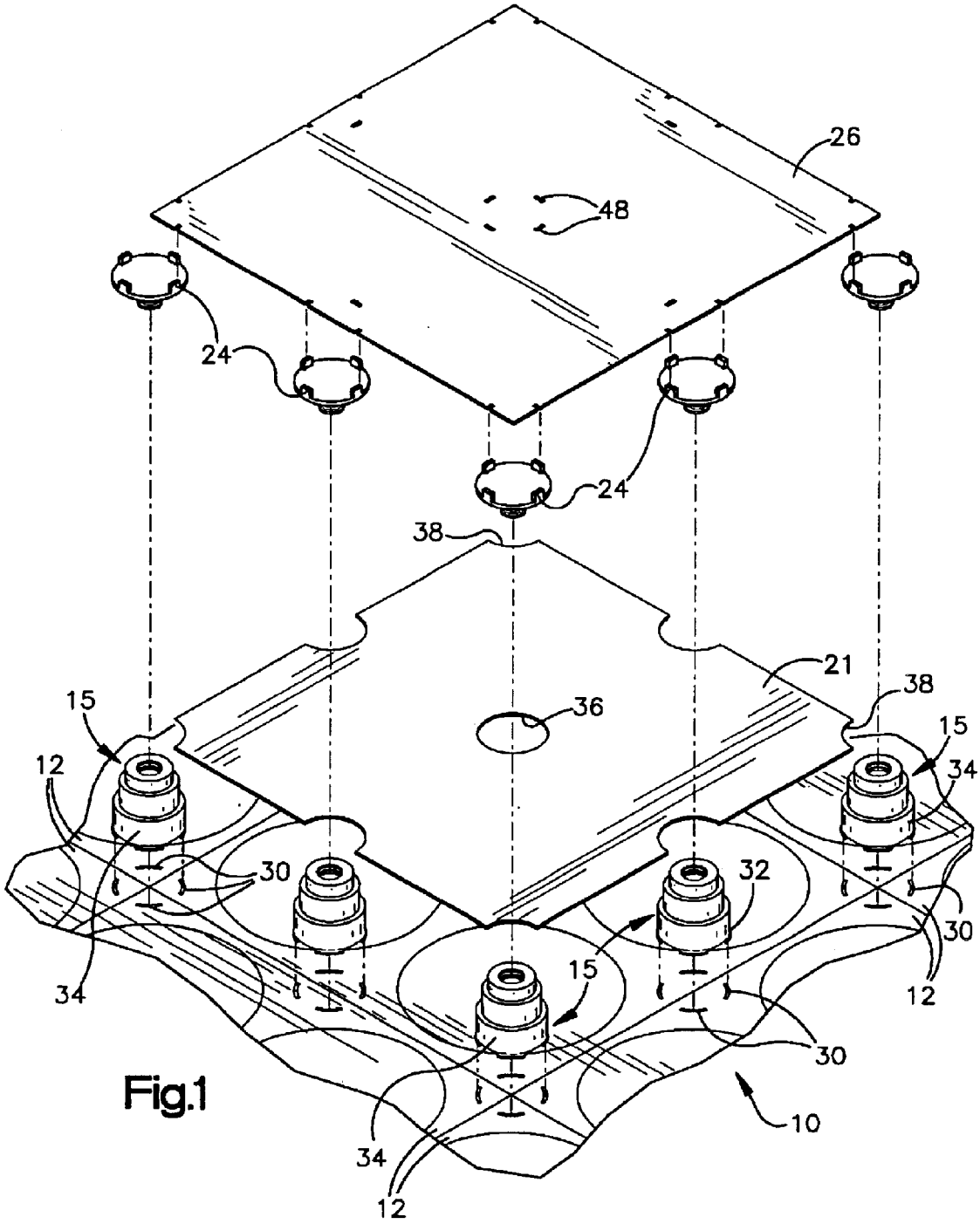
FIG. 1 is a fragmentary perspective view of a portion of a flooring system made in accordance with the present invention.

Referring to the drawings and to FIG. 1 in particular, a fragmentary portion of an assembled flooring system utilizing plastic components is shown generally at 10. A plurality of base panels 12 are provided. Each base panel has four relatively large through apertures 14 which are provided to minimize weight and material consumed.

A plurality of pedestals 15 are provided. The pedestals include base, central and top conical segments 16,18,20. The conical segments are axially aligned and contiguous to define support surfaces for panels. More specifically an annular surface 22 which is flat and horizontal when in use interconnects the base and central segments for support of cable floor panels 16. Similarly, a flat annular surface 24 interconnects the central and top segments 18,20 for support of communication panels(not shown). Pedestal caps 24 rest atop the pedestals to provide flat top surfaces 25 which function as support surfaces for work floor panels 26.

Figure 4:
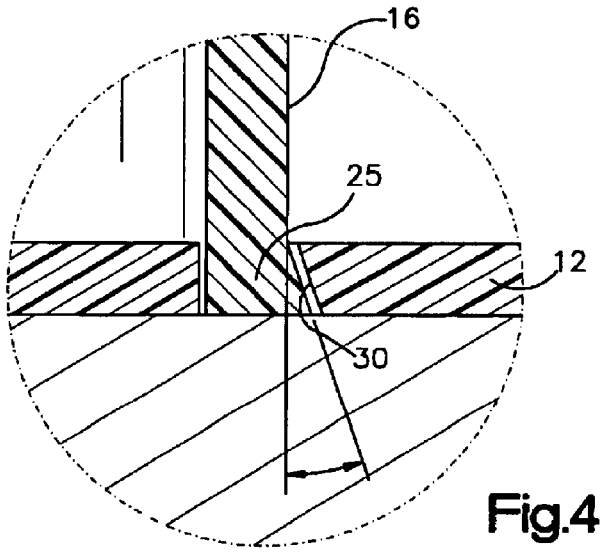
FIG. 4 is an enlarged sectional and fragmentary view of a pedestal to base panel interconnection; and, FIG. 5 is an elevational view of the non adjustable cap embodiment.

Each pedestal 15 includes four depending feet 28 extending downwardly from the base segment 16. The base segment is sufficiently flexible to allow the feet to snap into and interfit with complementally contoured recesses 30 in the base panels. The feet are of a vertical dimension equal to the thickness of the base floor panels. The outer surfaces of the feet taper outwardly and downwardly at a slight angle shown as 15 degrees in FIG. 4. As shown in FIG. 4, an outer recess defining surface in the base panel is complemental with and in surface engagement with an associated foot outer surface. Thus, the complemental surfaces lock the base panels and the pedestals together.

Figure 3:
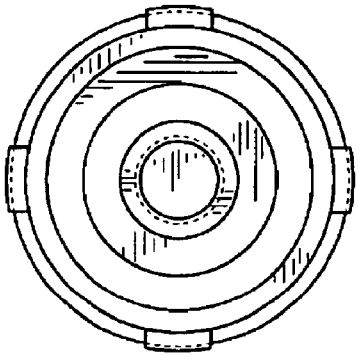
FIG. 3 is a bottom view of the pedestal of the present invention.

As is best seen by reference to FIGS. 1 and 3, there are four feet 28 which, depending on their location, engaged one, two or four of the base panels 12. Thus, a pedestal mounted atop the center of a panel has all four feet retentively engaged by the same panel. Where a pedestal bridges the joint between two adjacent panels as at 32 in FIG. 1, two feet interlock with each of the two panels. Where the panel is mounted at the juncture of four corners as at 34 in FIG. 1, the coaction of the feet and their complemental recesses 30 function to secure the four corners in appropriate relative orientation.

When a pedestal 15 is mounted along the edge of a panel array it will engage one, two or three panels and one or two of its feet will be outboard of the array. Since the feet have a vertical height equal to the thickness of the panels, the outboard feet will engage the supporting building floor and maintain the pedestals in a vertical orientation.

The cable floor and communication panels 21 and not shown are each flat, plastic sheets with cutouts to receive appropriate portions of the pedestals 15. Thus, the cable floor panels 16 each have a central circular aperture 36 sized to fit around the central conical segment 18. In addition, the cable floor panels have corner cutouts 38, each of which constitutes a quarter of a circle such that four adjacent panels 16' collectively surround a central conical segment 18 of a single pedestal 15. The cable floor panels have similar cutouts.

Figure 2:
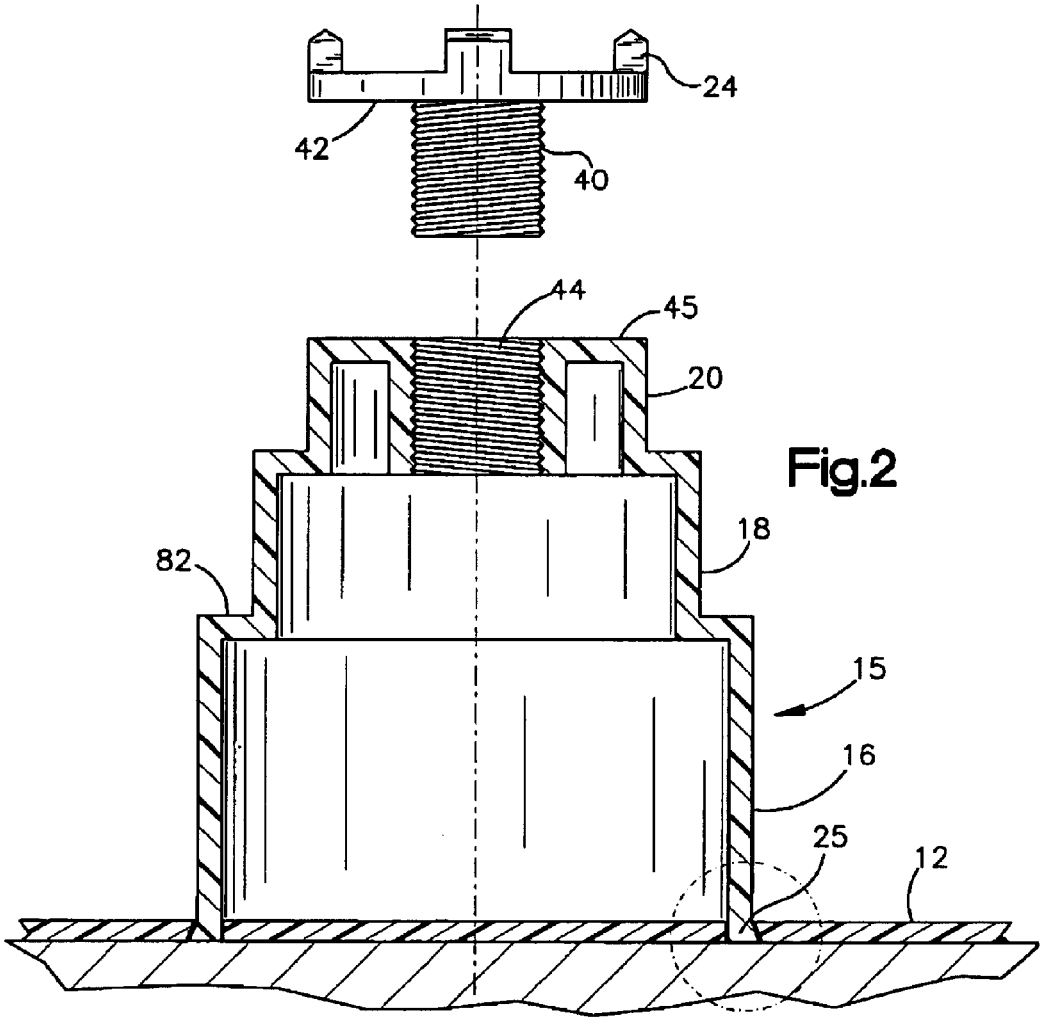
FIG. 2 is an enlarged sectional view of the pedestal and the threaded cap of the present invention.

Referring now to FIG. 2, the cap shown there has a threaded stem 40 projecting downwardly from a work floor support disc 42. Each pedestal 15 has a threaded, axial bore 44 extending downwardly from a flat, annular, top surface. The stem, when in use, threads into the bore 44 for leveling adjustment of work floor panel(s) resting atop the support disc 42. Each cap 24 four upstanding projections for locking engagement with complemental apertures in supported work floor panel(s) 26.

Figure 5:
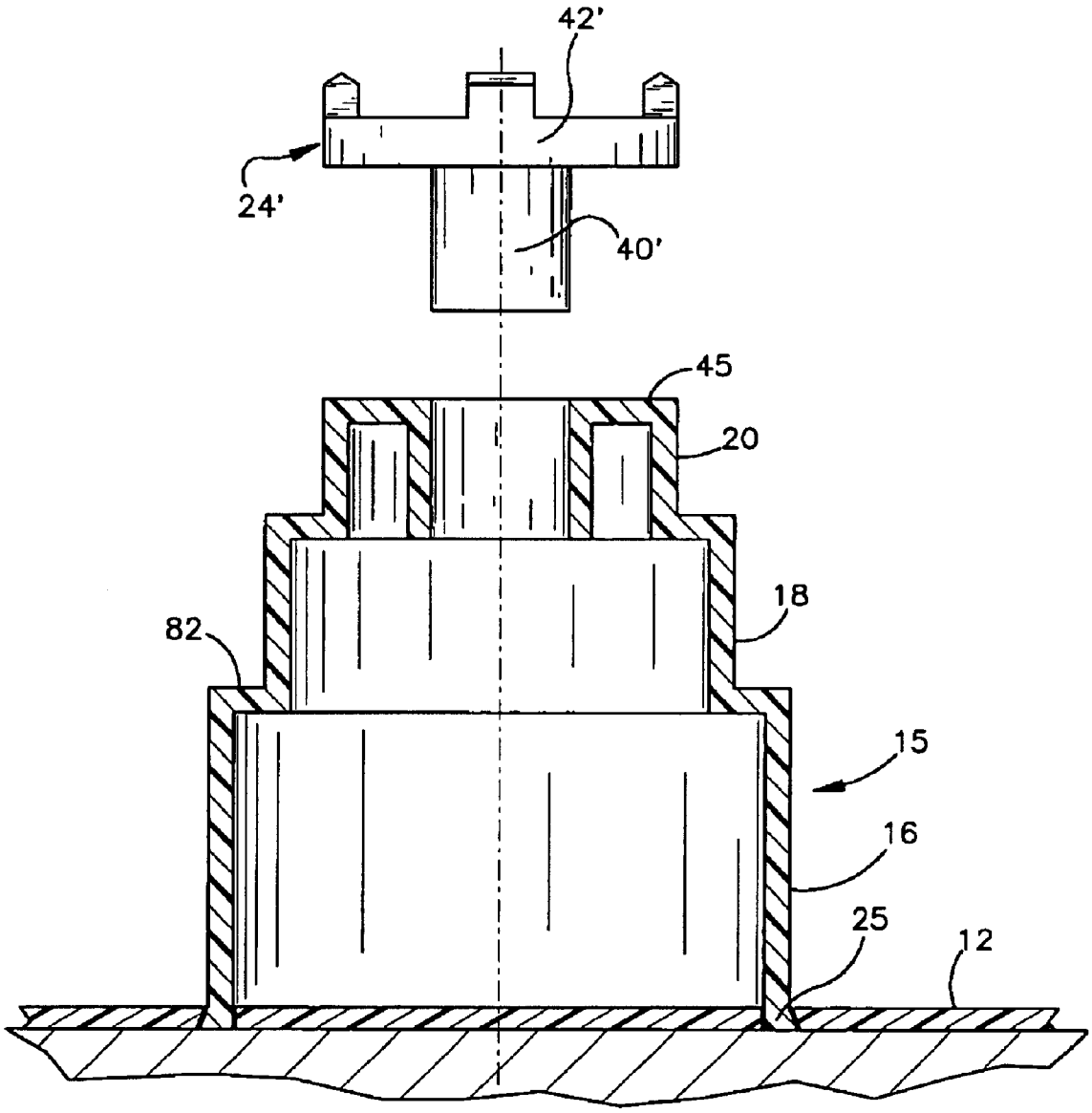

When floor leveling is not required the cap 24' of FIG. 5 is optionally employed. The differences between the caps of FIGS. 2 and 5 are the stem 40' has a smooth cylindrical surface and the disc 42' is thicker. The thickness is equal to the median in the adjustment range of the threaded stem embodiment 24. In use the smooth stems 40' are simply telescoped into coacting pedestal bores 44 in close but sliding fits.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A support system having multiple floors of a sub-work surface utility line containment system comprising in combination:

a) a plurality of pedestal sets;

b) a base floor for mounting on a floor of a building to be provided enhanced utility services;

c) the pedestal sets and the base floor being adapted to provide a geometric array of floor support pedestals;

d) the pedestals of the sets and the base floor having interlocking feet and apertures to secure their relative positions in the array when the pedestal sets are mounted atop the base floor; and, e) each pedestal being sufficiently flexible to allow the feet to be snapped into complimentary floor apertures and each foot having a downward and outwardly tapering surface engaging a complemental aperture defining surface to provide such interlocking; and f) each of the pedestals includes a removeable cap defining a work floor support surface for support of work floor panels.

2. The system of claim 1, wherein work floor panels are supported on the caps and cap projections extend into the apertures in the work floor panels to fix the relative positions of the panels, the caps and the pedestals.

3. The system of claim 2, wherein at least some of the caps are each threadably connected to a pedestal body for adjusting the height of the pedestal and thereby level the work floor panels.

4. The system of claim 1 wherein at least some of the pedestals are interlocked with a plurality of adjacent base floor panels whereby to secure said adjacent panels together.

5. The system of claim 4 wherein there are corner portions of four said adjacent base floor panels interlocked with at least one of said at least some pedestals.

6. The support system of claim 1 wherein at least one of the pedestals comprises:

a) a body having a top surface;

b) the body defining a bore extending axially downwardly from the top surface;

c) a cap including a support disc for supporting work floor panels; and, d) the cap also having a stem depending downwardly from the disc and extending into the bore.

7. The pedestal of claim 6 wherein the stem and bore are threaded for threading the stem into the bore.

8. The pedestal of claim 7 wherein the stem has a cylindrical surface for a close sliding fit with the bore threads.

9. The pedestal of claim 6 wherein the stem has a cylindrical surface for a close sliding fit with the bore threads.

10. The pedestal of claim 6 wherein the cap includes upwardly extending work floor engaging and locating projections.

* * * * *